US009224552B2

(12) United States Patent
Lee

(10) Patent No.: US 9,224,552 B2
(45) Date of Patent: Dec. 29, 2015

(54) KEYBOARD

(71) Applicant: Hyung Tae Lee, Seoul (KR)

(72) Inventor: Hyung Tae Lee, Seoul (KR)

(73) Assignees: Wenyu Zhang, Beijing (CN); LEETIS TECHNOLOGY DEVELOPMENT (HK) COMPANY LIMITED., Kowloon (HK)

( * ) Notice: Subject to any disclaimer, the term of this patent is extended or adjusted under 35 U.S.C. 154(b) by 247 days.

(21) Appl. No.: 13/726,960

(22) Filed: Dec. 26, 2012

(65) Prior Publication Data

US 2013/0228437 A1 Sep. 5, 2013

(30) Foreign Application Priority Data

Mar. 5, 2012 (KR) ..... 10-2012-0022195

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/70*** | (2006.01) |
| ***H01H 13/85*** | (2006.01) |
| *H01H 13/83* | (2006.01) |

(52) U.S. Cl.

CPC ..... *H01H 13/7006* (2013.01); *H01H 13/85* (2013.01); *H01H 13/83* (2013.01); *H01H 2215/006* (2013.01)

(58) Field of Classification Search

CPC .... H01H 13/83; H01H 13/7009; H01H 13/85
USPC ..... 200/314; 362/23.03
See application file for complete search history.

(56) References Cited

U.S. PATENT DOCUMENTS

| | | | | |
|---|---|---|---|---|
| 6,252,184 | B1 * | 6/2001 | Tsai et al. | 200/5 A |
| 6,657,139 | B2 * | 12/2003 | Hasunuma | 200/5 A |
| 8,183,478 | B2 * | 5/2012 | Lamers et al. | 200/5 A |
| 8,247,714 | B2 * | 8/2012 | Tsai | 200/5 A |
| 8,383,972 | B2 * | 2/2013 | Liu | 200/310 |
| 2011/0290628 | A1 * | 12/2011 | Tsai | 200/5 A |

* cited by examiner

*Primary Examiner* — Renee Luebke
*Assistant Examiner* — Lheiren Mae A Caroc
(74) *Attorney, Agent, or Firm* — Anova Law Group, PLLC

(57) ABSTRACT

An exemplary keyboard includes a keyboard shell; a supporting panel arranged to the keyboard shell and having a plurality of elastomer holes therein; a plurality of keycaps arranged on the lastomer holes; a plurality of keycap supports between the supporting panel and the corresponding keycaps; a plurality of elastomers being exposed out of the supporting panel; and an FPC sheet arranged under the supporting panel, and a key signal pads substrate arranged under the FPC sheet; the FPC sheet comprises a key signal pads layer with a plurality of upper key signal pads corresponding to the plurality of elastomers holes and a insulative layer with a plurality of connecting holes under the key signal pads layer; lower key signal pads corresponding to the upper key signal pads are arranged on the key signal pads substrate, the lower key signal pads opposite to the upper key signal pads.

10 Claims, 11 Drawing Sheets

KEYBOARD

FIELD OF THE INVENTION

The present disclosure relates to the art of keyboards and, particularly to a keyboard having backlight which illuminates under the bottom of the keycap.

DESCRIPTION OF RELATED ART

Keyboards usually are used for inputting signals to computers by tapping key bodies. Herein in this invention keyboard is an inputting device used for computer, portable computer and other devices having signals inputting.

Recently, a keyboard that can be used in dim with accurate operations and having light beams irradiated from undersides of the keycaps to the keycaps has been disclosed.

FIG. 11 is an exploded view of a conventional keyboard. FIG. 12 is a cross-sectional view of part of the conventional keyboard of FIG. 11. FIG. 13 is a cross-sectional view of an FPC sheet of the conventional keyboard of FIG. 11.

The conventional keyboard as shown in FIGS. 11~13, includes a keyboard shell 111, a supporting panel 112 integrated with the keyboard shell 111 and having a plurality of elastomer holes 112*a* therein, a plurality of keycaps 113 arranged on the elastomer holes 112*a*, a plurality of keycap supports 130 against the supporting panel 112 for supporting the keycap 113, an elastomer panel 150 arranged under the supporting panel 112, a flexible printed circuit (FPC) sheet 160 arranged under the elastomer panel 150, a light defusing panel 117 under the FPC sheet 160, a light emitting part 140 with a light emitting substrate 114 arranged under the light defusing panel 117, a main board (not shown) electrically connecting with the FPC sheet 114 and the light emitting part 140, and a rear panel 118 arranged under the light emitting substrate 114.

The keyboard shell 111 with the above described structure can be made of material of metal or metal alloy, such as aluminum, or can be made of material of hard synthetic resin.

The supporting panel 112 is exposed at the upper side of the keyboard shell 111, and integrated with the keyboard shell 111.

The keycap support 130 is constituted with an up-down guide portion 131 formed in an underside of the keycap 113, a pressure portion 132 formed inside of the up-down guide portion 131 and a guide rail 133 formed within a scope of a perimeter of the elastomer hole 112*a* of the supporting panel 112.

The up-down guide portion 131 has a protrusion 131*a* in a bottom end thereof. The pressure portion 132 has its bottom end contacting with a top end of an elastomer 151. The guide rail 133 has a limit corner 133*a* in its upper part.

The protrusion 131*a* and the limit corner 133*a* can be buckled with each other.

The keycap support 130 has such a configuration that the keycap 113 is closed to the supporting panel 112 when pressed down.

The elastomer panel 150 has elastomers 151 corresponding to the elastomer holes 112*a*. The elastomer 151 is arch-shaped overall, and a pressure protrusion 151*a* is formed inside.

The elastomer 151 with above described structure can be made of rubber or other elastic and transparent and half-transparent materials.

The FPC sheet 160 includes a middle insulative layer 162, an upper layer 161 and a lower layer 163 arranged at the two sides of the insulative layer 162 respectively, and outer connecting pads 164 electrically connecting with the upper layer 161 and the lower layer 163.

A plurality of connecting holes 162*a* corresponding to the elastomer holes 112*a* are arranged in the insulative layer 162 defined therein.

Upper key signal pads 161*a* and corresponding lower key signal pads 163*a* are formed on the corresponding upper layer 161 and lower layer 163 which have the same configuration as the elastomer holes 112*a*.

The outer connecting pads 114*a* are electrically connected to the upper key signal pads 161*a*, lower key signal pads 163*a*, and the main board (not shown).

With the above described structure, when the elastomer 151 is pressed by the keycap 113, as described later, a pressure protrusion 151*a* provides pressure to the upper key signal pad 161*a*, then the upper key signal pad 161*a* passes through the corresponding connecting hole 162*a* and connects the lower key signal pad 163*a*.

When the upper key signal pad 161*a* is connected to the lower key signal pad 163*a*, the key signal is in ON state.

When the pressure is released from the keycap 113, the upper key signal pad 161*a* is separated from the lower key signal pad 163*a*, then the key signal is in OFF state.

The ON state and OFF state signals are transmitted to the main body of a computer through the outer connecting pads 164 and the main board (not shown).

The light defusing panel 117 has arch-shaped lens 117*a* disposed beneath the elastomers 151. The light emitting part 140 has light emitting substrate 141 and light emitting members 142 disposed on the light emitting substrate 141.

The light emitting substrate 141 is preferably selected from metal PCB, ceramic PCB and such high-temperature substrates.

The light emitting substrate 141 is electrically connected to the main board (not shown).

Light emitting driver chips are arranged on the light emitting substrate 141. The light emitting driver chips receive light emitting control signals from the computer via the main board (not shown), and drive the light emitting members 142 to emit light beams.

The light emitting members 142 can be light emitting diodes (LEDs).

The light emitting members 142 with the above described structure is arranged on the light emitting substrate 141, and are under the arch-shaped lens 117*a*.

Light beams emitted from the light emitting members 142 cross the arch-shaped lens 117*a* and the elastomer 151, and reach the upper side of the supporting panel 112.

The driving voltage of the light emitting member 142 is from a battery in the keyboard shell 111 or from the main body of a computer.

The main board (not shown) is electrically connected to the computer via electric codes The rear panel 118 is mounted to the keyboard shell 111 by screws or by other integration process.

In the following, the assembling method of the above-described keyboard will be disclosed.

Firstly, the keycaps 113 are installed. The keycap support 130 is supported on the supporting panel 112.

Finally, when the elastomer panel 150, the FPC sheet 160, the light defusing panel 117, and the light emitting substrate 141 are installed between the keyboard shell 111 and the rear panel 118, the rear panel 118 is fastened to the keyboard shell 111 by screws.

The above described keyboard is disclosed in Korean patent with patent application number 54613 (named as light emitting keyboard).

However, the elastomer 151 are formed on the elastomer panel 150. The upper key signal pads 161*a* and the lower key signal pads 153*a* are arranged n the FPC sheet 160. The light emitting members 142 disposed on the light emitting substrate 141. This structure increases the total thickness of the keyboard and is not convenient for the user.

Therefore, it is desirable to provide a keyboard which can overcome the above-mentioned problem.

SUMMARY

This invention discloses a keyboard with decreased thickness.

An exemplary keyboard includes a keyboard shell; a supporting panel arranged to the keyboard shell and having a plurality of elastomer holes therein; a plurality of keycaps arranged on the corresponding elastomer holes; a plurality of keycap supports between the supporting panel and the corresponding keycaps; a plurality of elastomers through the corresponding elastomer holes and being exposed out of the supporting panel; an FPC sheet arranged under the supporting panel, and a key signal pads substrate arranged under the FPC sheet; the FPC sheet comprises a key signal pads layer with a plurality of upper key signal pads corresponding to the plurality of elastomers holes and an insulative layer with a plurality of connecting holes under the key signal pads layer; lower key signal pads corresponding to the upper key signal pads are arranged on the key signal pads substrate, the lower key signal pads opposite to the upper key signal pads; the cross-section area of the elastomer hole is greater than that of the elastomer; the light emitting members corresponding to the connecting holes are arranged on the key signal pads substrate, when the light emitting member emits light, the light beams go through the light through holes and the elastomer holes, and reach the upper side of the supporting panel; the elastomers are arranged on the key signal pads layer, when pressure is supplied on the keycap, the corresponding key signal pads layer is pressed and make the upper key signal pads electrically connected to the lower key signal pads.

Furthermore, keycap support has a cross structure, the top of the keycap support is jointed to the keycap, and the bottom of the keycap support is jointed to the supporting panel, the keycap support has a scissors-like structure.

Furthermore, the key signal pads substrate is selected from metal PCB and ceramic PCB.

Furthermore, the elastomer is made of transparent material.

Furthermore, the keyboard shell is made of material of metal or metal alloy or hard synthetic resin.

The keyboard in this invention provides an FPC sheet, and a plurality of upper key signal pads conduction layer and an insulative layer are arranged in the FPC sheet. At the same time, the keyboard also provides a plurality of lower key signal pads corresponding to the upper key signal pads, thus a thickness of the keyboard is reduced.

DETAILED DESCRIPTION

Reference will now be made to describe an exemplary embodiment of the present disclosure in detail.

Figure 1:
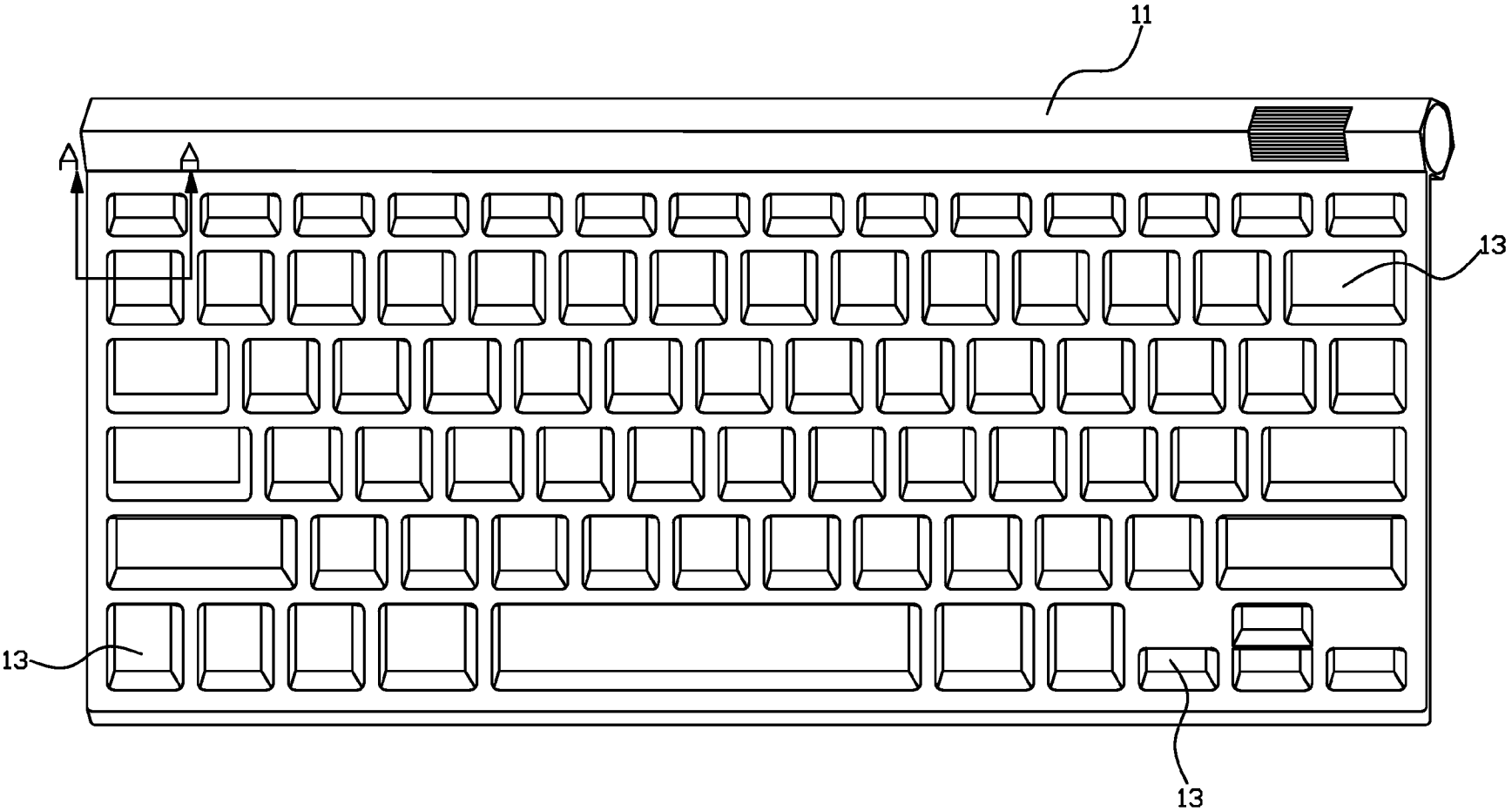
FIG. 1 is an illustrative view of a keyboard in accordance with an exemplary embodiment of the present invention.
Figure 2:
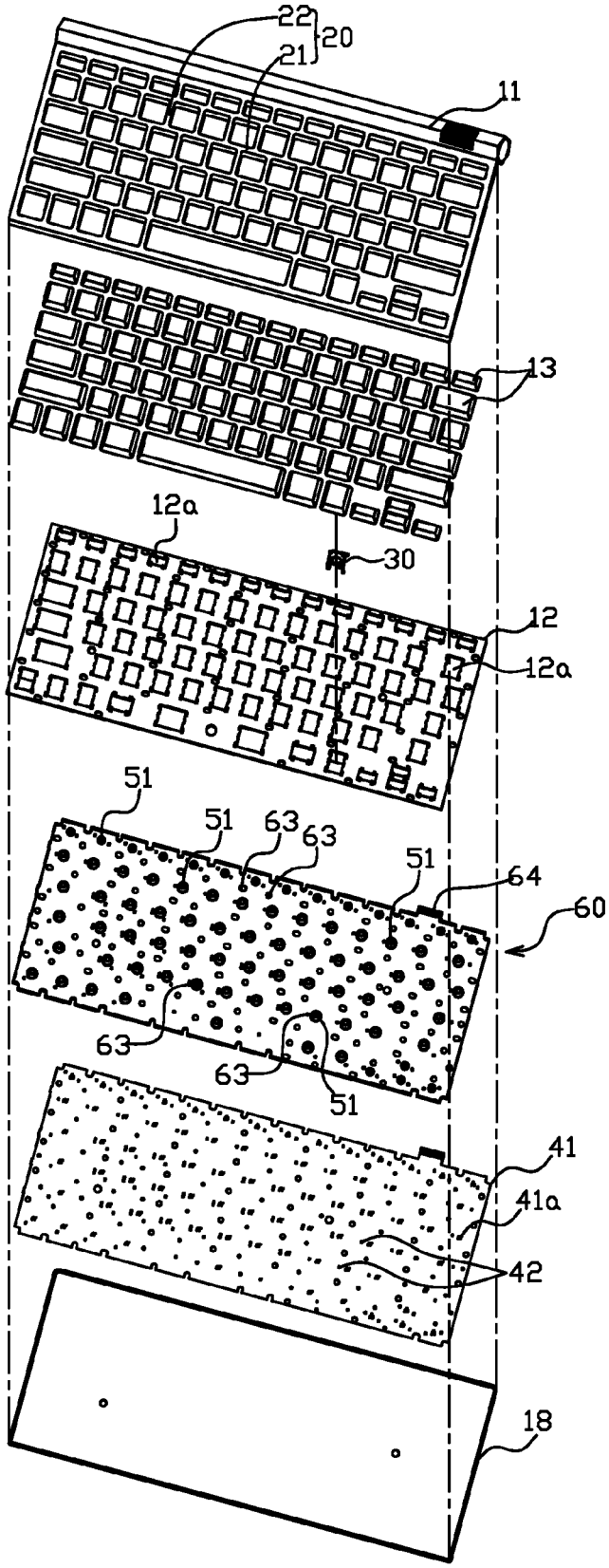
FIG. 2 is an exploded view of the keyboard in accordance with an exemplary embodiment of the present invention.
Figure 3:
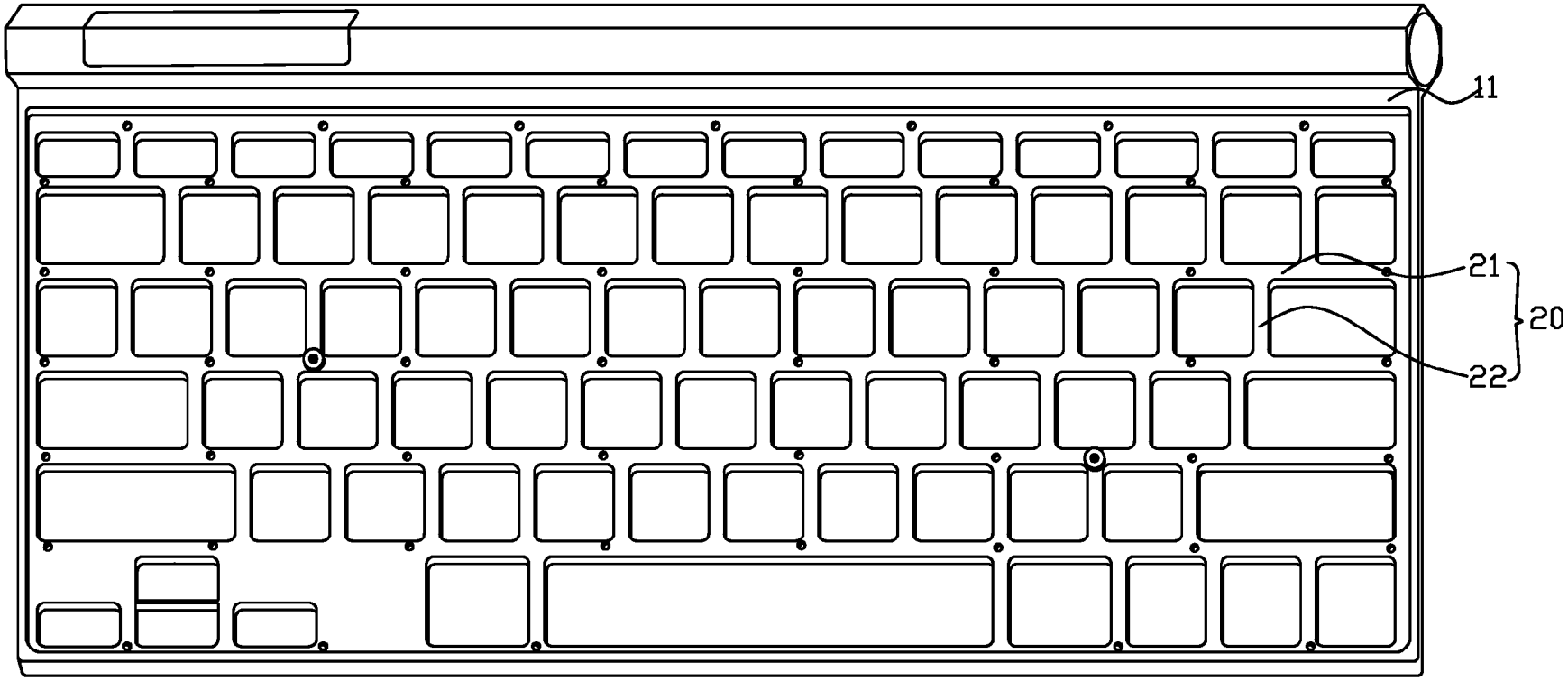
FIG. 3 is an illustrative back view of a keyboard shell of the keyboard of FIG. 2.
Figure 4:
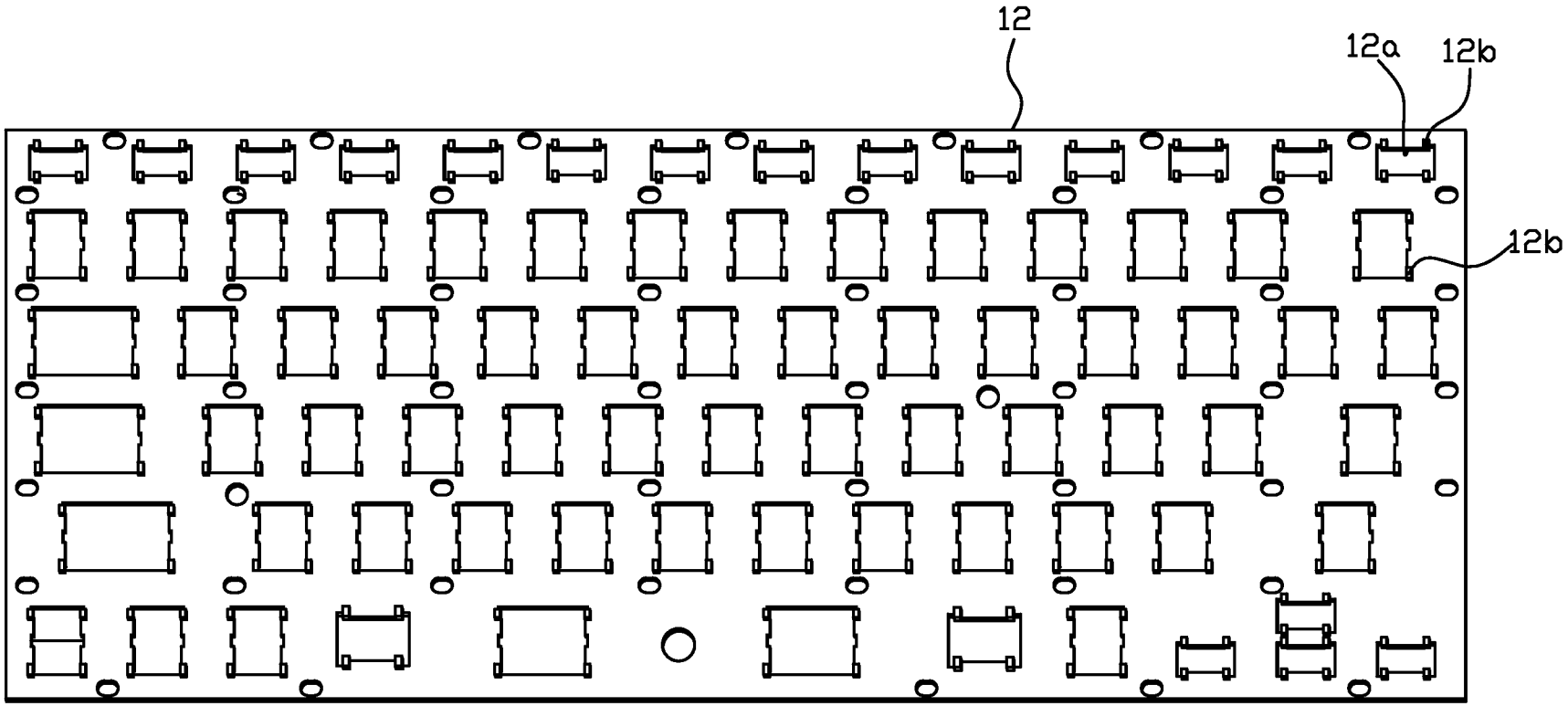
FIG. 4 is a plan view of a supporting panel of the keyboard of FIG. 2.
Figure 5:
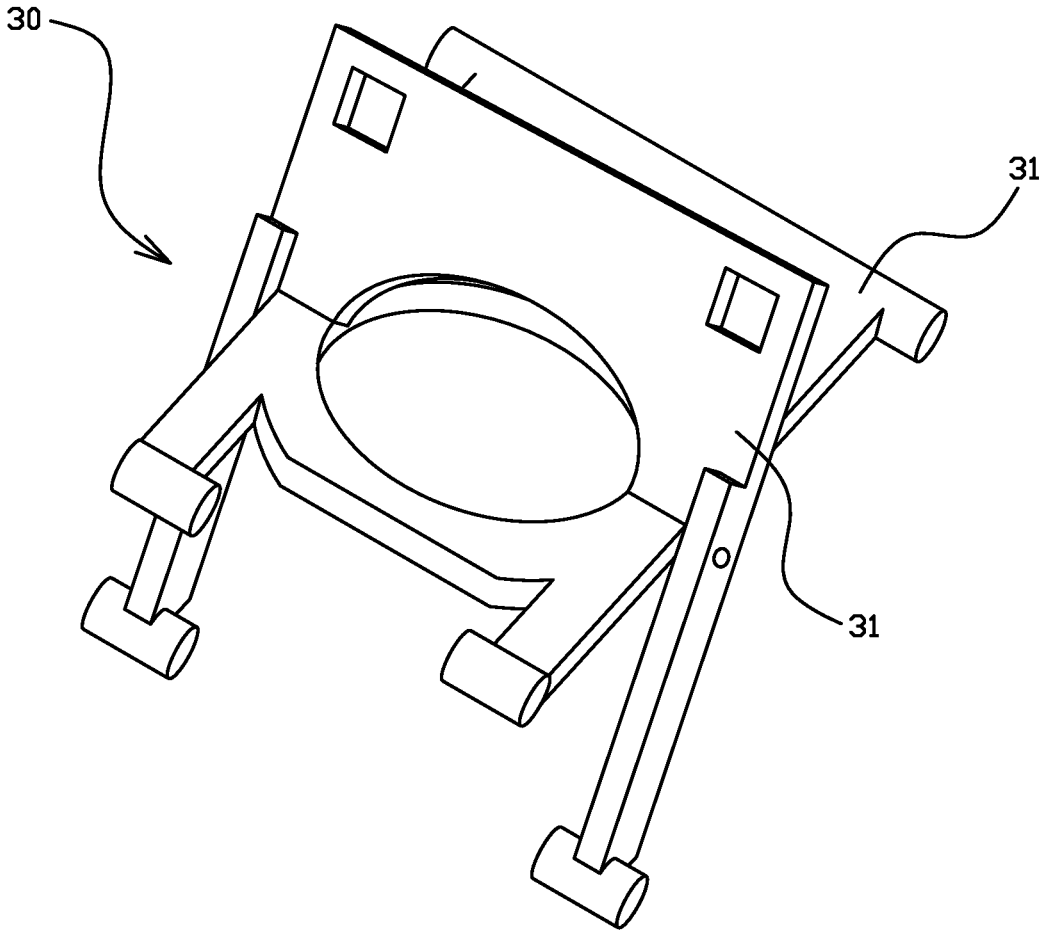
FIG. 5 is an illustrative view of a keycap support of the keyboard of FIG. 2.
Figure 6:
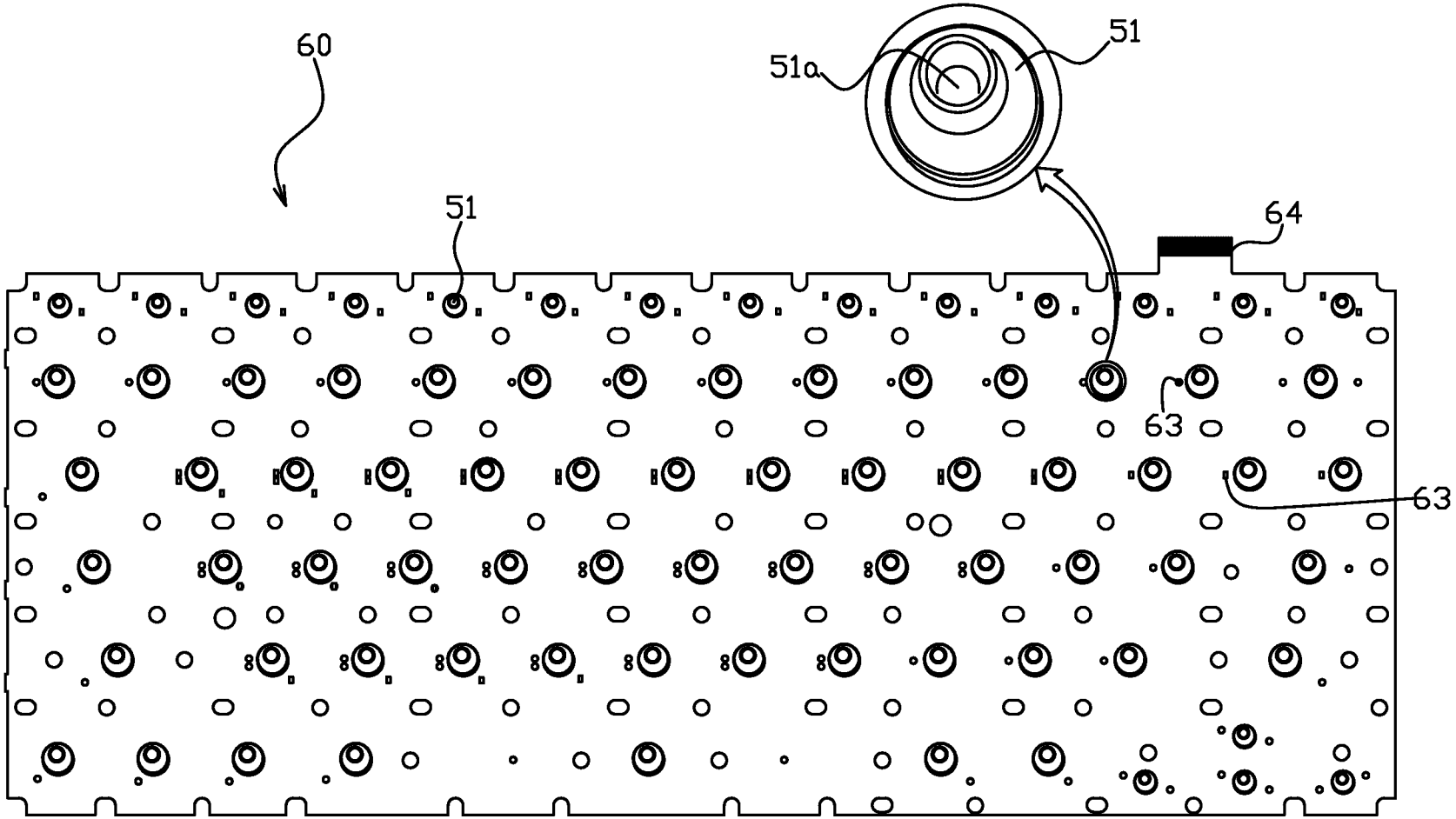
FIG. 6 is a plan view of an FPC sheet of the keyboard of FIG. 2.
Figure 7:
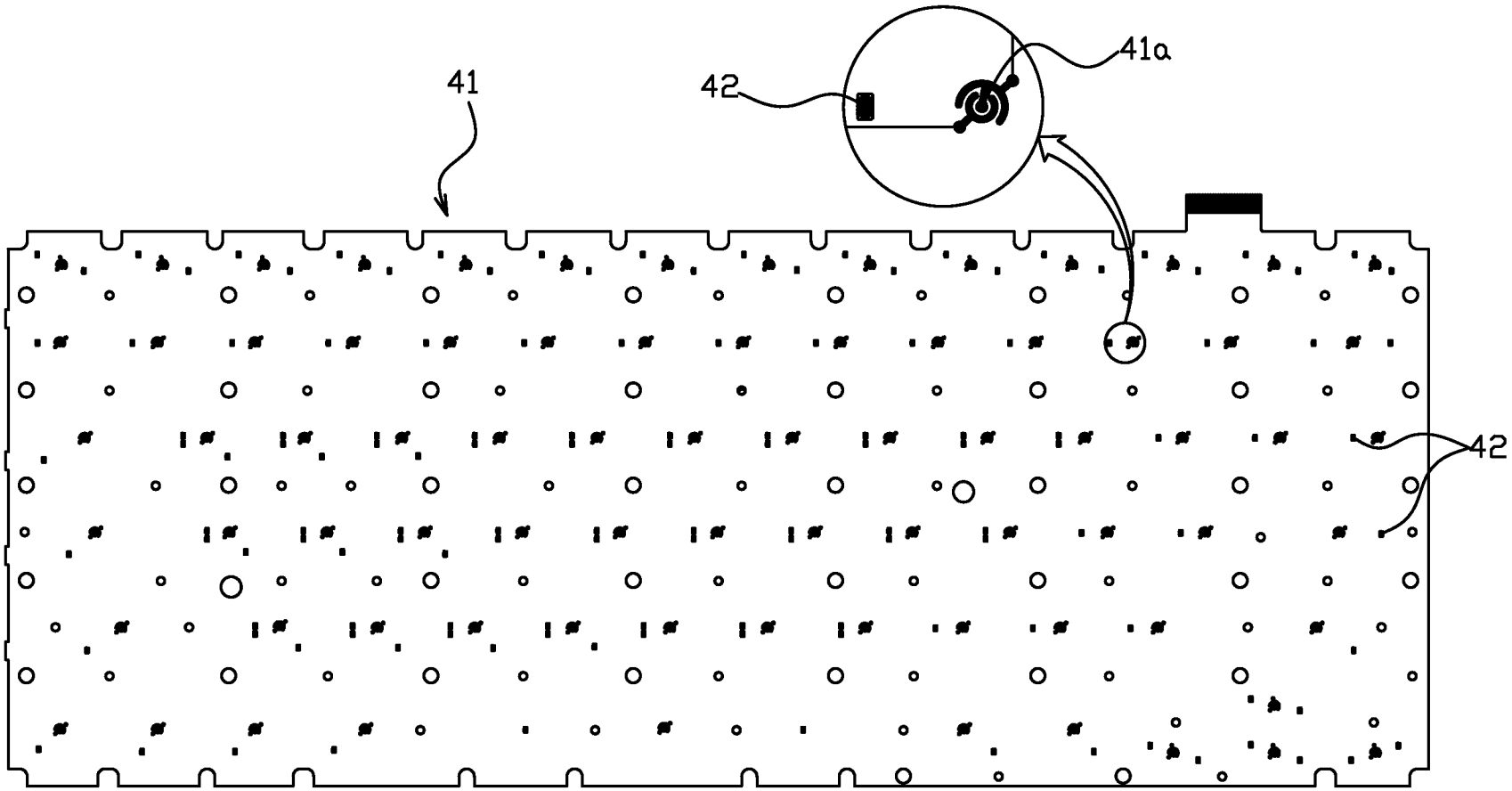
FIG. 7 is an illustrative view of a key signal pads substrate of the keyboard of FIG. 2.
Figure 8:
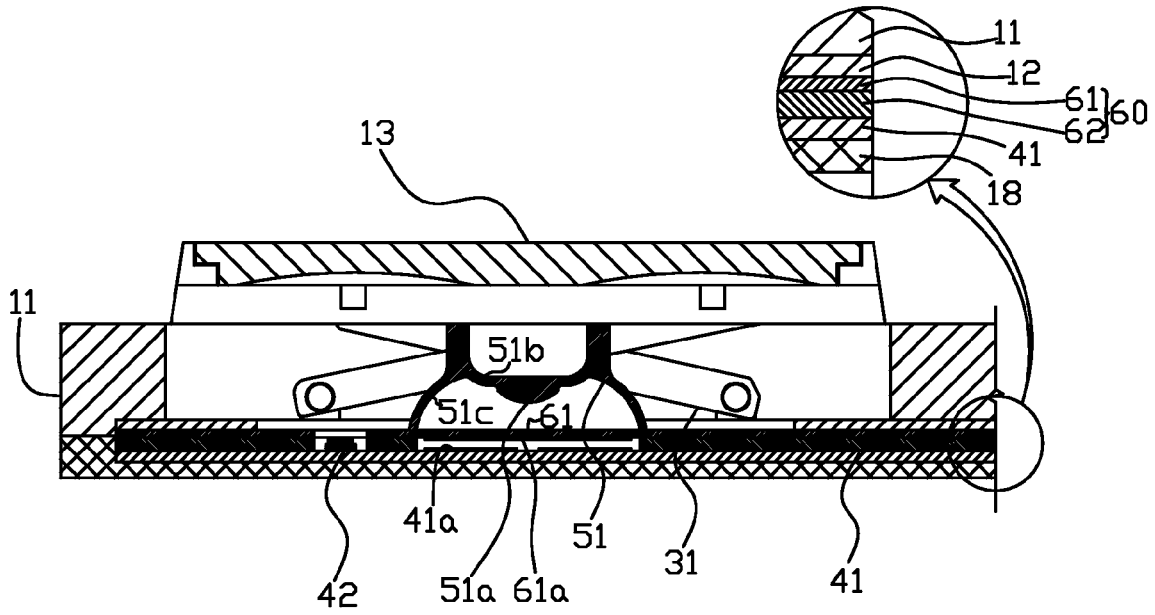
FIG. 8 is an enlarged cross-sectional view of the keyboard along line A-A in FIG. 1.
Figure 9:
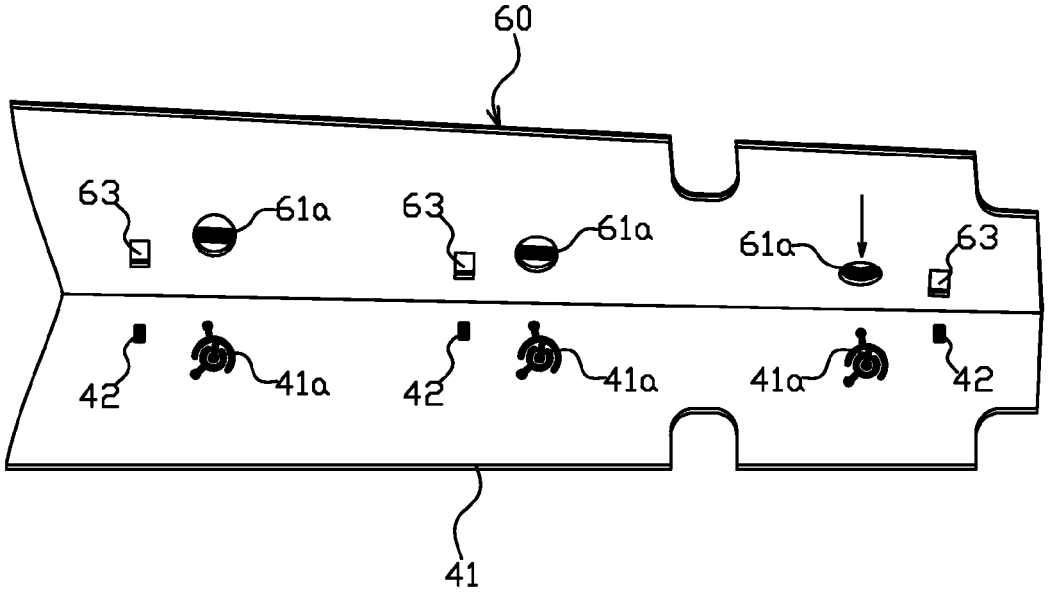
FIG. 9 is an illustrative view of a combination of the key signal pads substrate and the FPC sheet in accordance with an exemplary embodiment of the present invention.
Figure 10:
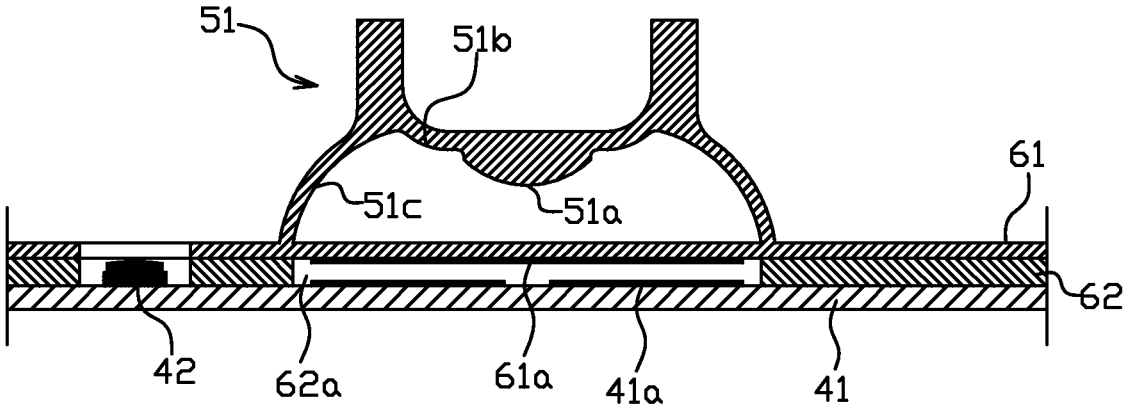
FIG. 10 is an illustrative view of a combination of the key signal pads substrate, the FPC sheet and the elastromer in accordance with an exemplary embodiment of the present invention.
Figure 11:
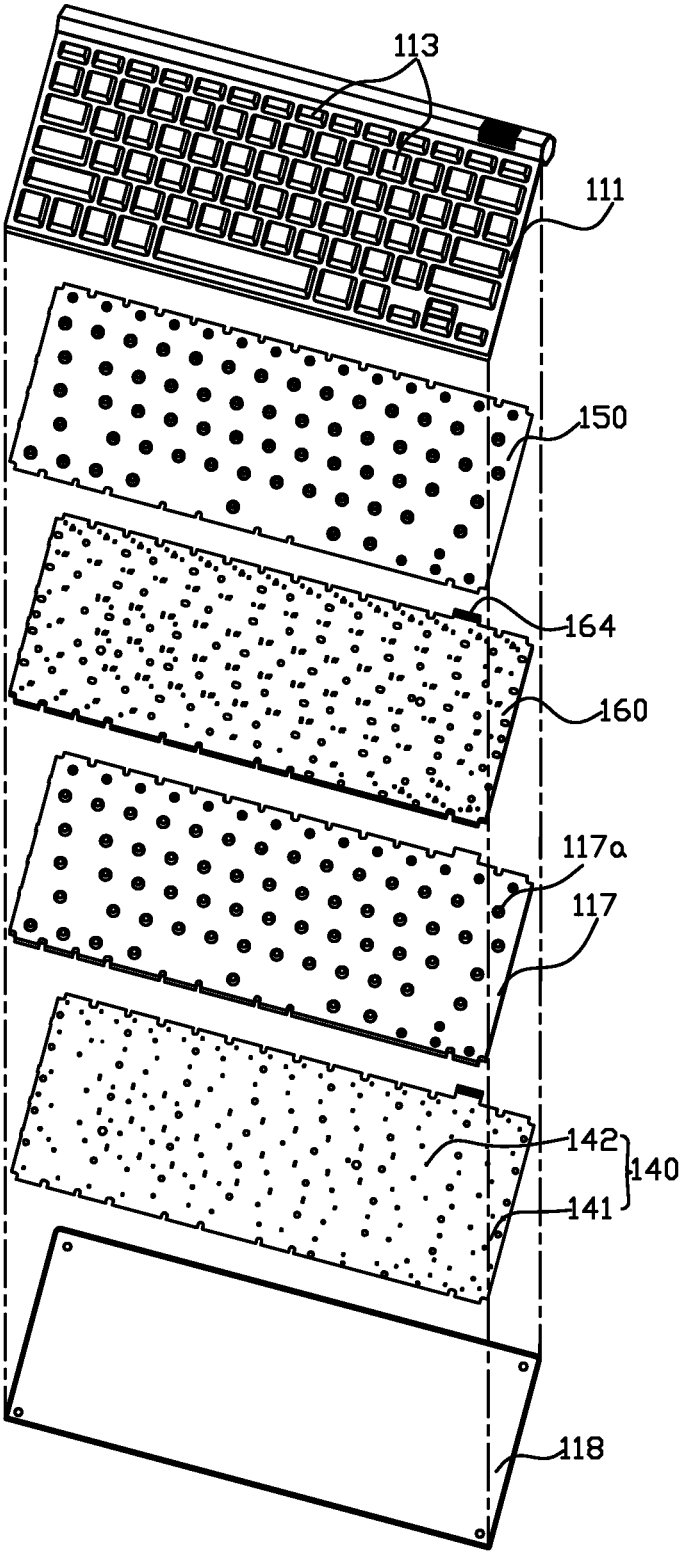
FIG. 11 (Prior Art)
FIG. 11 is an exploded view of a conventional keyboard.
Figure 12:
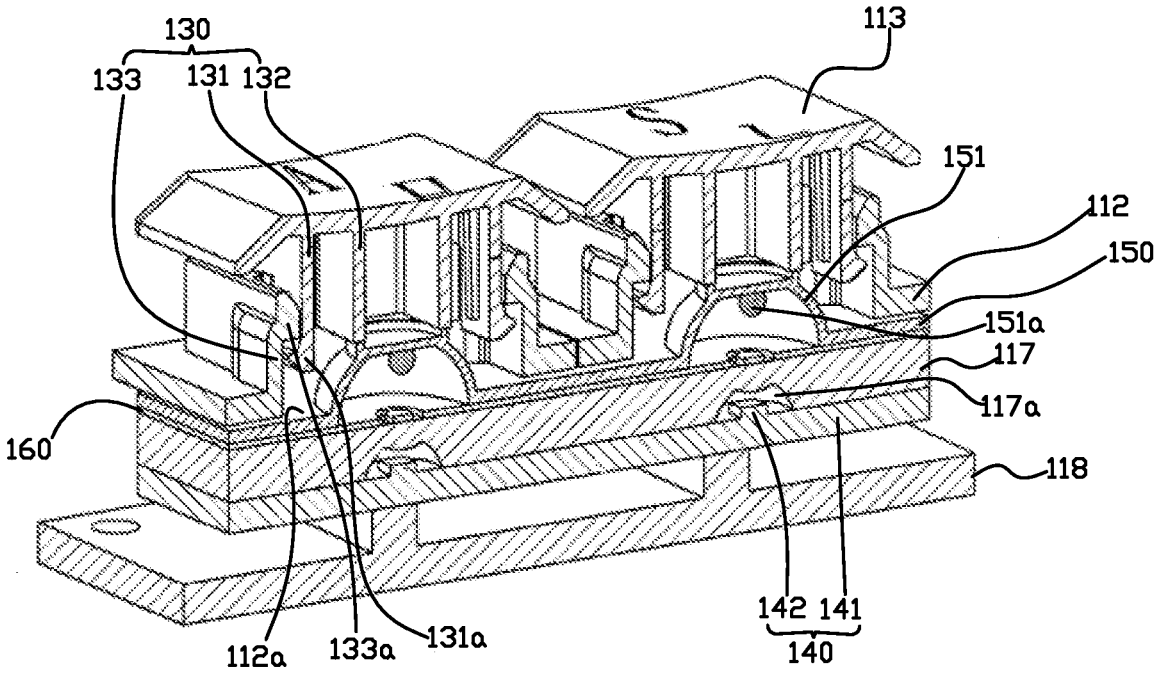
FIG. 12 (Prior Art)
FIG. 12 is a cross-sectional view of part of the conventional keyboard of FIG. 11.
Figure 13:
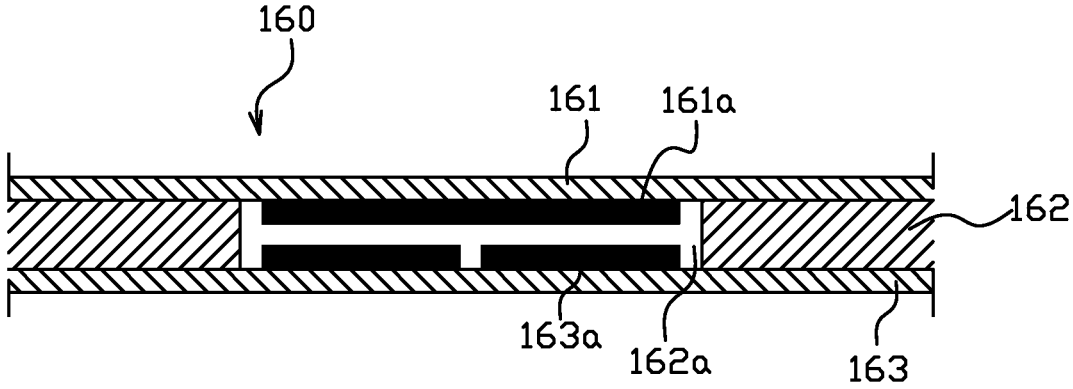
FIG. 13 (Prior Art)
FIG. 13 is a cross-sectional view of an FPC sheet of the conventional keyboard of FIG. 11.

FIG. 1 is an illustrative view of a keyboard in accordance with an exemplary embodiment of the present invention; FIG. 2 is an exploded view of the keyboard in accordance with an exemplary embodiment of the present invention; FIG. 3 is an illustrative back view of a keyboard shell of the keyboard of FIG. 2. FIG. 4 is an illustrative view of a supporting panel of the keyboard of FIG. 2. FIG. 5 is an illustrative view of a keycap support of the keyboard of FIG. 2. FIG. 6 is an illustrative view of an FPC sheet of the keyboard of FIG. 2. FIG. 7 is an illustrative view of a key signal pads substrate of the keyboard of FIG. 2. FIG. 8 is an enlarged cross-sectional view of the keyboard along line A-A in FIG. 1. FIG. 9 is an illustrative view of a combination of the key signal pads substrate and the FPC sheet in accordance with an exemplary embodiment of the present invention, and FIG. 10 is an illustrative view of a combination of the key signal pads substrate, the FPC sheet and the elastromer in accordance with an exemplary embodiment of the present invention.

The key board of the present invention as illustrated in the figures, includes a keyboard shell 11, a supporting platform 20 formed on the keyboard shell 11, a supporting panel 12 arranged to the keyboard shell 11 with a plurality of elastomer holes 12*a*, a plurality of keycaps 13 arranged on the elastomer holes 12*a*, a plurality of keycap supports 30 against the supporting panel 12 for connecting the keycap 13, a key signal pads substrate 41 arranged under the supporting panel 12, a plurality of elastomers 51 arranged on the key signal pads substrate 41, a plurality of light emitting members 42 arranged on the key signal pads substrate 41, a main board (not shown) electrically connecting the the key signal pads substrate 41, and a rear panel 18 arranged under the the key signal pads substrate 41.

The keyboard shell 11 with the above described structure can be made of material of metal or metal alloy, such as aluminum, or can be made of material of hard synthetic resin.

The supporting platform 20 includes a plurality of horizontal parts 21 and a plurality of vertical parts 22 connected with each other, thereby forming a plurality of grids arranged in matrix. The horizontal parts 21 have screw holes 21*a* formed on its bottom. The grids formed by the horizontal parts 21 and the vertical parts 22 do not interfere the elastomers 51 and the keycap supports 30. The supporting platform 20 reaches the top of the supporting panel 12.

Four supporting protrusions 12*b* around each elastomer hole 12*a* are formed on the supporting panel 12. A cross-sectional area of the elastomer holes 12*a* is greater than that of the elastomers 51. The space between the elastomer holes 12*a* and the elastomers 51 defines the area for light beams transmission.

The keycap support 30 with scissor shape includes a pair of connection parts 31 intersected with each other, and upper parts and lower parts are pivotally connected to a supporting protrusion 12*b* of the supporting panel 12 and the keycap 13.

The scissor shaped keycap support 30 uses normal technology with the detailed description omitted With the above described structure, when the keycap 13 is pushed down, the keycap 13 is close to the top of the supporting panel 12.

Besides of the scissors-like structure, the keycap support 30 can also be any other exited structure, such as the mechanic keycap support with a guiding slide.

The FPC sheet 60 includes a key signal pads layer 61 with key signal pads 61*a* corresponding to the elastomer holes 12*a*, and an insulative layer 62 arranged under the key signal pads layer 61.

Connecting holes 62*a* corresponding to the upper key signal pads layer 61*a* are arranged in the insulative layer 62.

Light through holes 63 are formed around the connecting holes 62*a* on the FPC sheet 60

The FPC sheet 60 with the above described structure is arranged under the supporting panel 12.

The outer connecting pads 64 of the FPC sheet 60 are electrically connected to the upper key signal pads 61*a* and the main board (not shown).

The FPC sheet 60 is water resistant.

The elastomers 51 can be made of rubber or other elastic or transparent materials. In this invention, the semitransparent material is also included.

With the above described structure, when the elastomer 51 is pressed by the keycap 13 with pressure, the upper key signal pad 61*a* is pressed to connect the lower key signal pad 41*a*. The elastomer 51 goes through the elastomer hole 12*a*, and extends out of the elastomer hole 12*a*, then disposed on the key signal pads layer 61.

The elastomer 51 with the above described structure is adhered on the key signal pads layer 61 with adhesive material or integrated on the key signal pads layer 61.

The key signal pads substrate 41 is arranged under the FPC sheet 60, and the lower key signal pads 41*a* corresponding to the upper key signal pads 61*a* are formed thereon, thereby, the lower key signal pads 61*a* are opposite to the lower key signal pads 41*a*. The FPC sheet 60 can be adhered on the key signal pads substrate 41.

The lower key signal pads 41*a* have the similar arrangement to the elastomer holes 12*a*. And the key signal pads substrate 41 are electrically connected to the main board (not shown).

Light emitting driver chips (not shown) are arranged on the key signal pads substrate 41. The light emitting driver chips receive light emitting control signals from the computer or a keyboard MCU IC, and drive the light emitting members 42 to emit light beams. The light emitting members 42 can be light emitting diodes (LEDs).

When the elastomer 51 is pressed by the keycap 13, the pressure enhancing protrusion 51*a* is close to the key signal pads layer 61, and the upper key signal pads 61*a* is electrically connected to the lower key signal pads 41*a* through the connecting holes 62*a*.

When the upper key signal pad 61*a* is connected to the lower key signal pad 41*a*, the key signal is in ON state.

When the pressure is released from the keycap 13, the upper key signal pads 61*a* is separated from the lower key signal pads 41*a*, and then the key signal is in OFF state. The ON state and OFF state signal are transmitted to the computer through the outer connecting pads 64, the key signal pads substrate 41 and the main board (not shown).

The key signal pads substrate 41 is preferably selected from metal PCB, ceramic PCB and FPC.

The light emitting members 42 are arranged on the key signal pads substrate 41, each corresponding one of the connecting holes 62*a*.

The light emitting members 42 exposed at the upper side of the supporting panel 12 through the corresponding light through holes 63. When the light emitting member emits light, the light beams go through the elastomer holes 12, and reach the upper side of the supporting panel 12.

The light emitting members 42 can be light emitting diodes (LEDs).

The driving voltage of the light emitting member 42 is from a battery in the keyboard shell 11 or from the computer.

The main board (not shown) is electrically or wirelessly connected to the computer via communication codes.

The rear panel 18 has a caved fixing portion and can be fastened with the keyboard shell using screws or other integration process.

The process of assembling the keyboard with above described structure is described as follows.

First of all, the keycap supports 30 are arranged on the supporting panel 12. Then the keycaps 13 are arranged on the keycap supports 30. Then the key signal pads substrate 41 and the FPC sheet 60 are combined together. Thereafter the key signal pads substrate 41 and the FPC sheet 60 are screwed on the supporting panel 12.

At the last, the supporting panel 12, the key signal pads substrate 41, and the FPC sheet 60 are arranged between the keyboard shell 11 and the rear panel 18, with screws screwing on the rear panel 18 and the keyboard shell 11.

As the described embodiment of the invention, in order to guide the light beams of the light emitting members 42 to the upper side of the supporting panel 12, the cross-section area of the elastomer hole 12*a* is greater than that of the elastomer 51. Because the elastomer is made of transparent material, light beams from the light emitting members 42 can go through the elastomer 51, and reach the upper side of the supporting panel 12. In this invention, the elastomer 51 can also be made of semitransparent material.

Moreover, the FPC sheet 60 includes an key signal pads layer 61 with upper key signal pads 61*a* corresponding to the elastomer holes 12*a*, and an insulative layer 62 arranged under the key signal pads layer 61, and the key signal pads substrate 41 with lower key signal pads 41*a* corresponding to the upper key signal pads 61*a* is arranged under the insulative layer 62. The light emitting members 42 are arranged on the key signal pads substrate 41. Thus the whole thickness of the keyboard is reduced.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A keyboard comprising:

a keyboard shell;

a supporting panel arranged to the keyboard shell and having a plurality of elastomer holes therein;

a plurality of keycaps arranged on corresponding elastomer holes;

a plurality of keycap supports between the supporting panel and corresponding keycaps;

a plurality of elastomers through corresponding elastomer holes and being exposed out of the supporting panel;

an FPC sheet arranged under the supporting panel, and a key signal pads substrate arranged under the FPC sheet;

wherein the FPC sheet comprises a plurality of light through holes, each of the light through holes corresponds to a respective keycap and is formed under a corresponding elastomer hole, a plurality of light emitting members are disposed on an upper surface of the key signal pads substrate and respectively received in the light through holes;

wherein light beams emitted by light emitting members are transmitted through corresponding light through holes and elastomer holes respectively, and reach an upper side of the supporting panel.

2. The keyboard as claimed in claim 1, wherein each keycap support has a scissors-like structure, a top of the keycap support is jointed to a corresponding keycap, and a bottom of the keycap support is jointed to the supporting panel.

3. The keyboard as claimed in claim 1, wherein the key signal pads substrate is selected from metal PCB or ceramic PCB.

4. The keyboard as claimed in claim 1, the elastomer is made of transparent material.

5. The keyboard as claimed in claim 1, wherein the keyboard shell is made of material of metal or metal alloy or hard synthetic resin.

6. The keyboard as claimed in claim 1, wherein the FPC sheet comprises a key signal pads layer with a plurality of upper key signal pads corresponding to the plurality of elastomers holes and an insulative layer with a plurality of connecting holes under the key signal pads layer; and the key signal pads substrate comprises a plurality of lower key signal pads opposite to the upper key signal pads of the FPC sheet respectively.

7. The keyboard as claimed in claim 6, wherein the elastomers are arranged on the key signal pads layer of the FPC sheet, and when a pressure is applied on a keycap, the key signal pads layer is pressed and force a corresponding upper key signal pad to be electrically connected to a lower key signal pad.

8. The keyboard as claimed in claim 7, wherein a cross-section area of the elastomer hole is greater than that of the elastomer.

9. The keyboard as claimed in claim 1, wherein the light emitting members face the keycaps and emit the light beams upwards to the keycaps through the light through holes and elastomer holes respectively.

10. A keyboard comprising:

a keyboard shell;

a supporting panel arranged to the keyboard shell and having a plurality of elastomer holes therein;

a plurality of elastomers arranged through corresponding elastomer holes and being exposed out of the supporting panel;

a plurality of keycaps arranged on the elastomers respectively;

a plurality of keycap supports between the supporting panel and corresponding keycaps;

an FPC sheet arranged under the supporting panel, and a key signal pads substrate arranged under the FPC sheet;

wherein the the FPC sheet comprises a plurality of light through holes, each of the light through holes corresponds to a respective keycap and is formed under a corresponding elastomer hole, a plurality of light emitting members are disposed on an upper surface of the key signal pads substrate and respectively received in the light through holes;

wherein the light emitting members face the keycaps and emit the light beams upwards, and the light beams are transmitted to the keycaps through the corresponding light through holes and elastomer holes respectively.

* * * * *